US005536186A

United States Patent [19]

Watanabe

[11] Patent Number: 5,536,186

[45] Date of Patent: Jul. 16, 1996

[54] FEMALE TERMINAL AND METHOD OF MANUFACTURING THE SAME

[75] Inventor: Tamio Watanabe, Shizuoka-ken, Japan

[73] Assignee: Yazaki Corporation, Tokyo, Japan

[21] Appl. No.: 283,174

[22] Filed: Aug. 3, 1994

[30] Foreign Application Priority Data

Aug. 3, 1993 [JP] Japan ..... 5-192356

[51] Int. Cl.[6] ..... H01R 13/187

[52] U.S. Cl. ..... 439/843; 439/851

[58] Field of Search ..... 439/842–845, 439/849, 851–856, 861, 862, 833, 839

[56] References Cited

U.S. PATENT DOCUMENTS

| | | | |
|---|---|---|---|
| 4,560,231 | 12/1985 | Shirai | 439/843 |
| 4,880,401 | 11/1989 | Shima et al. | 439/843 |
| 5,186,664 | 2/1993 | Abe | 439/843 |
| 5,226,842 | 7/1993 | Endo et al. | 439/843 |

FOREIGN PATENT DOCUMENTS 64-12383 1/1989 Japan .

*Primary Examiner*—David L. Pirlot

*Attorney, Agent, or Firm*—Wigman, Cohen, Leitner & Myers

[57] ABSTRACT

A female terminal for receiving a male terminal includes a main body having a box part for receiving the male terminal and a leaf spring to be accommodated in the box part. The box part has engaging notches formed in both sidewalls thereof, respectively. The leaf spring has raised projections which are arranged on both sides of an end in a longitudinal direction thereof. Further, engaging projections are provided at both inlets of the engaging notches of the box part. In assembly, when each of the raised projections pass through each of the engaging projections, the former deforms the latter elastically. After the raised projections pass through the engaging projections. They serve to prevent the raised projections restored elastically to their original configurations from coming out of the engaging notches.

5 Claims, 4 Drawing Sheets

(d)

S1
S2

FEMALE TERMINAL AND METHOD OF MANUFACTURING THE SAME

BACKGROUND OF THE INVENTION

The present invention relates to a female terminal which consists of a main body and a leaf spring made of a material different from that of the main body to increase an engaging force with a male terminal to be engaged therewith and a method for manufacturing the female terminal.

This kind of female terminal is disclosed in Japanese Utility Model Laid-open (kokai) No. 64-12383, which is shown in FIG. 1.

The female terminal 1 consists of a main body 7 made of inductive material and a leaf spring 10 made of high-elastic material, such as beryllium copper, phosphorus bronze etc. The main body 7 includes a box part 3 and a wire-crimping part 5. The box part 3 is provided on both sidewalls with through bores 12, respectively. On the other hand, the leaf spring 10 has projections 14 formed on both sides of one end thereof in the longitudinal direction. Inserting the leaf spring 10 into the box part 3 and then engaging the respective projections 14 with the through bores 12, the leaf spring 10 is assembled in the main body 7 integrally. A turnover piece 16 is formed at the inlet of the box part 3 in order to facilitate an insertion of a not-shown male terminal.

FIGS. 2 and 3 show sequent processes to assemble the female terminal 1, respectively. As shown in FIG. 2 which consists of a series of plan views of processes to attach the leaf spring 10 to the box part 3, the spring 10 is connected to a linked body 20 through the intermediary of connecting portions 18 at the beginning. Thereafter, the leaf spring 10 is separated from the linked body 20 when the spring 10 is assembled to the box body 3.

In detail, as shown in FIGS. 2(*a*), (*b*) and FIGS. 3 (*a*), (*b*), the leaf spring 10 connected to the linked body 20 through the connecting portions 18 is set up in the box part 3 under a semi-folded condition, which is also connected to a not-shown linked body. Then, as shown in FIG. 2(*c*) and FIG. 3(*c*), the connection portions 18 and 18 are cut thereby separating the leaf spring 10 from the linked body 20. Thereafter, the projections 14 and 14 are engaged into the through bores 12 and 12, respectively, so that the leaf spring 10 is fitted into the box part 3. Finally, as shown in FIGS. 2(*d*), (*e*) and FIGS. 3(*d*), (*e*), the box part 3 is folded completely to thereby form a configuration of box.

In the above-mentioned prior art terminal, since the female terminal 1 has a construction to engage the projections 14 and 14 into the through bores 12 and 12, there is necessity to assemble the leaf spring 10 into the box part 5 under condition that mating portions thereof are opened and thereafter, to close the mating portions, whereby such processes are complicated and troublesome for an operator. Furthermore, a distance S2 between the mating portions of the box part 3 in the opening state is established to be larger than a distance S1 between both ends of the projections 14 and there is a margin in distance between the through bores 12 and the projections 14. Therefore, if an external force such as vibration is applied on the box part 3 when setting up the leaf spring 10 on the bottom face of the part 3, the projections 14 may be withdrawn from the through bores 12, so that the female terminal in which the box part 3 is closed under such a condition would be rejected.

SUMMARY OF THE INVENTION

It is therefore an object of the present invention to provide a female terminal capable of setting up the a leaf spring in position of a box part securely while offering an easy assembly.

It is another object of the present invention to provide a method for manufacturing such a female terminal.

The former object of the invention described above can be accomplished by a female terminal for receiving a male terminal, comprising:

a main body having a box part for receiving the male terminal, the box part having an opening formed at one end thereof;

a leaf spring arranged in the box part;

elastic raised projections arranged on both sides of an end of the leaf spring in a longitudinal direction thereof;

engaging notches formed in both sidewalls of the box part, respectively, through which the raised projections are to be inserted from the opening of the box part; and engaging projections arranged at both inlets of the engaging notches so as to deform the raised projections elastically when they pass through the engaging projections and to prevent the raised projections restored elastically to their original configurations from coming out of the engaging notches after the raised projections pass through the engaging projections.

With the arrangement of the invention, since the engaging notches are provided instead of the above mentioned through bores, the female terminal allows the leaf spring to be assembled to the box part by inserting the leaf spring thereinto through the opening. During assembling, the raised projections pass through the engaging projections, deforming elastically. After passing through the engaging projections, the raised projections are restored elastically to their original configurations and retained in the engaging notches securely since the engaging projections prevent the raised projections from coming out of the engaging notches.

According to the present invention, there is also provided a female terminal for receiving a male terminal, comprising:

a main body having a box part for receiving the male terminal, the box part having an opening formed at one end thereof;

a leaf spring arranged in the box part;

elastic raised projections arranged on both sides of an end of the leaf spring in a longitudinal direction thereof;

engaging notches formed in both sidewalls of the box part, respectively, through which the raised projections are to be inserted from the opening of the box part; and engaging projections arranged at both Inlets of the engaging notches so as to deform the raised projections elastically when they pass through the engaging projections and to prevent the raised projections restored elastically to their original configurations from coming out of the engaging notches after the raised projections pass through the engaging projections, each of the engaging projections being provided at the inlet with a slanted surface for facilitating the elastic deformation of each of the raised projections.

With the above mentioned arrangement, since each of the engaging projections is provided at the inlet with a slanted surface, it is possible to execute the Inserting operation of the leaf spring with ease.

Preferably, the box part is provided on a bottom wall at the opening end thereof with a turnover piece which has a leading end facing an inside of the box part.

Owing to the turnover piece of the box part, it becomes to be possible to prevent the leaf spring from coming out of the box part securely.

The latter object of the Invention described above can be accomplished by a method for manufacturing a female terminal for receiving a male terminal, comprising the following steps of:

preparing a main body which has a box part for receiving the male terminal, the box part having an opening formed at one end thereof and having engaging notches formed in both sidewalls thereof, the engaging notches being provided at both inlets thereof with engaging projections, respectively;

preparing a leaf spring which has elastic raised projections formed on both sides of an end thereof in a longitudinal direction thereof;

inserting the leaf spring into the box part through the opening of the box part in such a manner that, when the raised projections pass through the engaging projections, the raised projections are deformed elastically by the engaging projections, respectively; and thereafter engaging the raised projections of the leaf spring with the engaging notches in such a manner that, after the raised projections pass through the engaging projections, the engaging projections prevent the raised projections restored elastically to their original configurations from coming out of the engaging notches, respectively.

In the present invention, since the raised projections of the leaf spring are engaged into the engaging notches by inserting the leaf spring into the box part from the opening, there is no need to open the box part in a semi-folded state to set up the leaf spring, so that it is possible to form the box part in a closed state from the beginning.

These and other objects and features of the present invention will become more fully apparent from the following description and appended claims taken in conjunction with the accompanying drawings.

DESCRIPTION OF THE PREFERRED EMBODIMENT

One embodiment of the present invention is now described with reference to the drawings.

Figure 1:
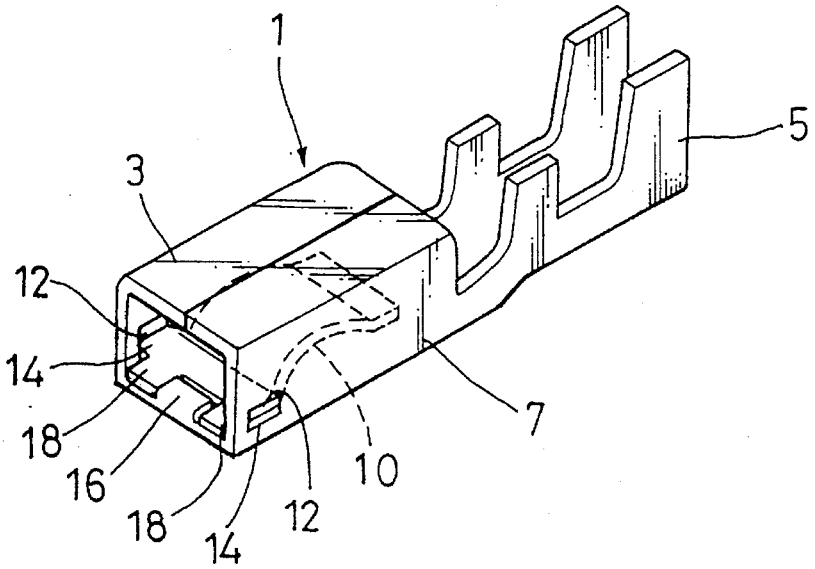
FIG. 1 PRIOR ART
FIG. 1 is a perspective view showing a conventional female terminal.
Figure 4:
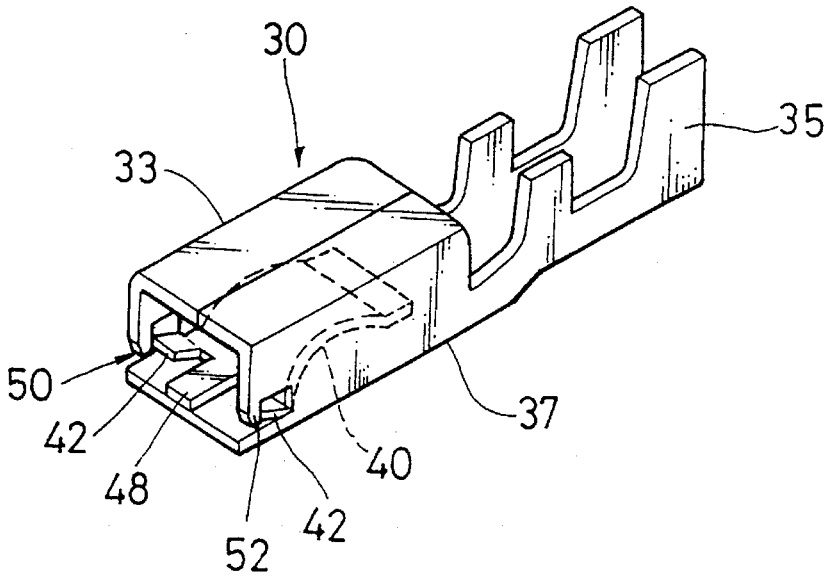
FIG. 4 is a perspective view showing a female terminal according to an embodiment of the present invention.
Figures 2A, 2B, 2C, 2D, 2E, 3A, 3B, 3C, 3D, 3E:
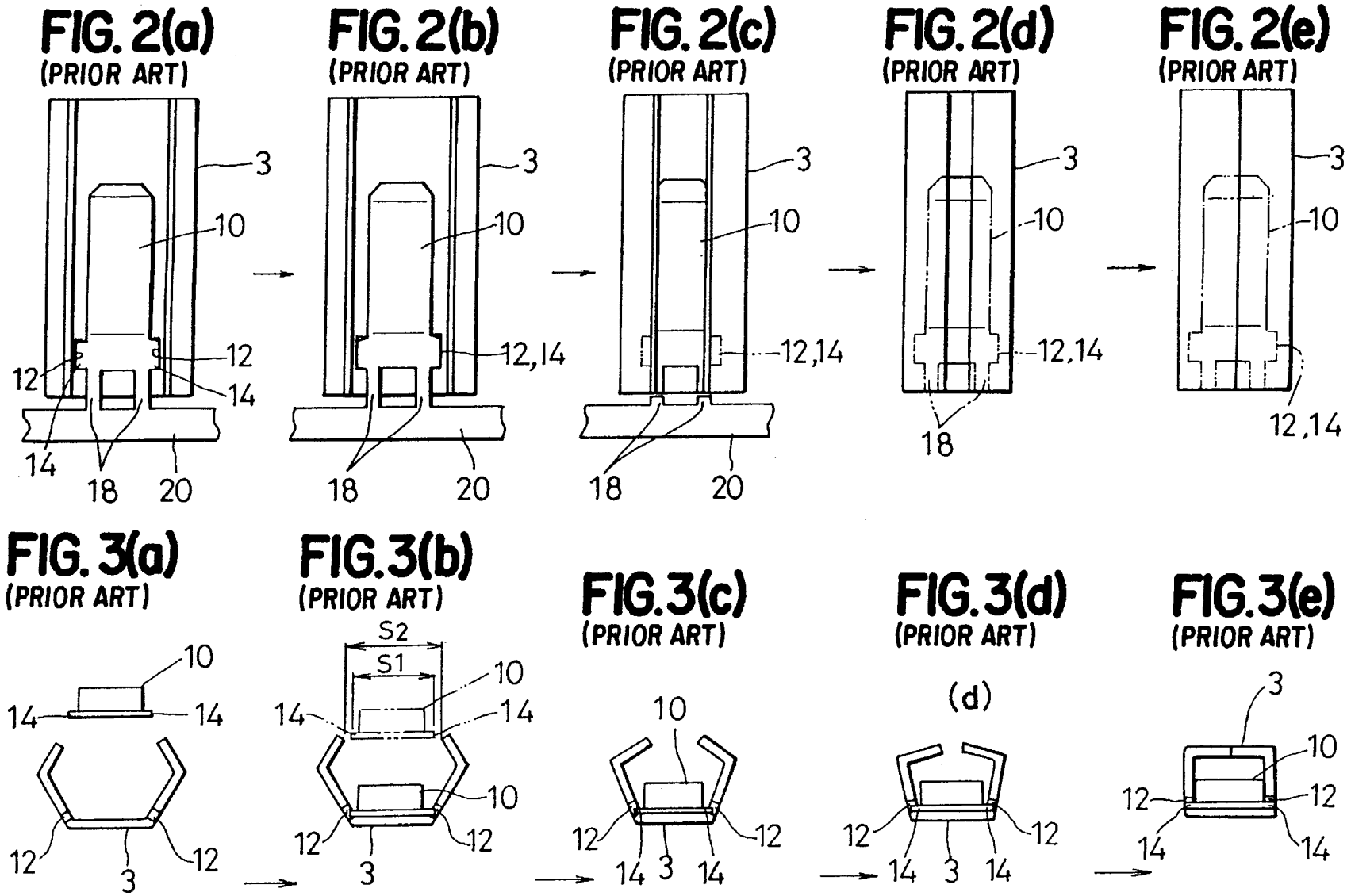
FIG. 2(a) (PRIOR ART)
FIG. 2(b) (PRIOR ART)
FIG. 2(c) (PRIOR ART)
FIG. 2(d) (PRIOR ART)
FIG. 2(e) (PRIOR ART)
FIG. 3(a) (PRIOR ART)
FIG. 3(b) (PRIOR ART)
FIG. 3(c) (PRIOR ART)
FIG. 3(d) (PRIOR ART)
FIG. 3(e) (PRIOR ART)
FIG. 2 shows various plan views of the conventional female terminal in sequent processes of manufacturing the same.
FIG. 3 shows various front views of the conventional female terminal, which correspond to the plan views of FIG. 2, respectively.
Figure 5:
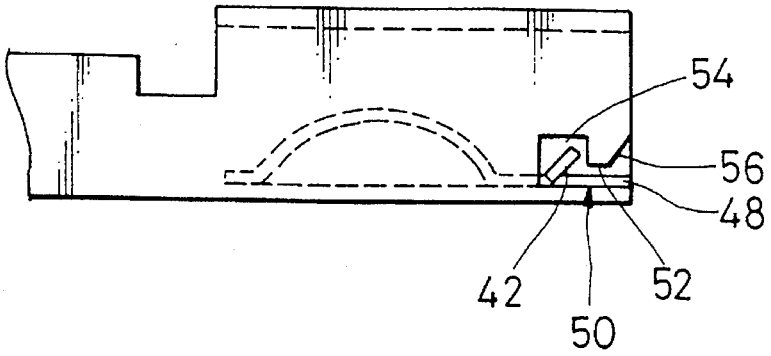
FIG. 5 is a partial side view of the female terminal of FIG. 4.

FIGS. 4 and 5 show structures of a female terminal according to an embodiment of the present invention. The female terminal 30 of the invention consists of a main body 37, which includes a box part 33 and a wire-crimping part 35, and a leaf spring 40 of high elastic material, which is set up in the box part 33.

The leaf spring 40 is provided on both sides of one end thereof with raised projections 42 which are bent obliquely in the longitudinal direction. A connecting portion 48 is arranged between the raised projections 42.

In order to engage the leaf spring 40 in the box part 33, notches 50 for engagement, which will be referred as "engaging notches" hereinafter, are formed in both sidewalls of the box part 33, respectively. Each of the engaging notches 50 is so formed as to allow the raised projections 42 to be inserted into the box part 33 through an opening end thereof.

Arranged at respective inlets of the engaging notches 50 are projections 52 which will be referred as "engaging projections" hereinafter to distinguish them from the raised rejections 42. Each of the engaging projections 52 serves to deform each raised projection 42 elastically when the leaf spring 40 is inserted into the box part 33 so that the raised projections 42 pass through the engaging projections 52. Further, once the raised projections 42 of the leaf spring 40 are inserted into the engaging notches 50 to pass through the engaging projections 52, they serve to prevent the raised projections 42, which are restored elastically to its original configuration at the time, from coming out of the engaging notches 50, respectively.

As shown in FIG. 5, each of the engaging notches 50 is provided at the heart of the engaging projection 52 with a space 54 to accommodate the raised projection 42 therein. Further, in order to facilitate the above mentioned elastic deformation of the raised projections 42 of the leaf spring 40 when it is set up into the box part 33, a slanted surface 56 is formed at the respective front ends of the engaging projections 52.

We now describe a method of setting up the leaf spring 40 into the main body 37.

Figure 6A:
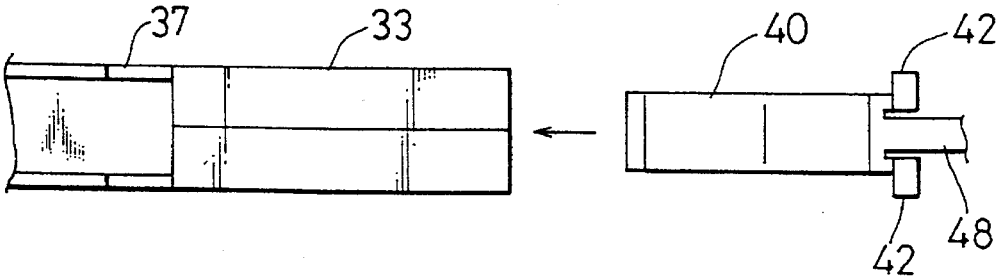
FIG. 6A is a plan view showing the female terminal of FIG. 4 in process of manufacturing the same.
Figure 6B:
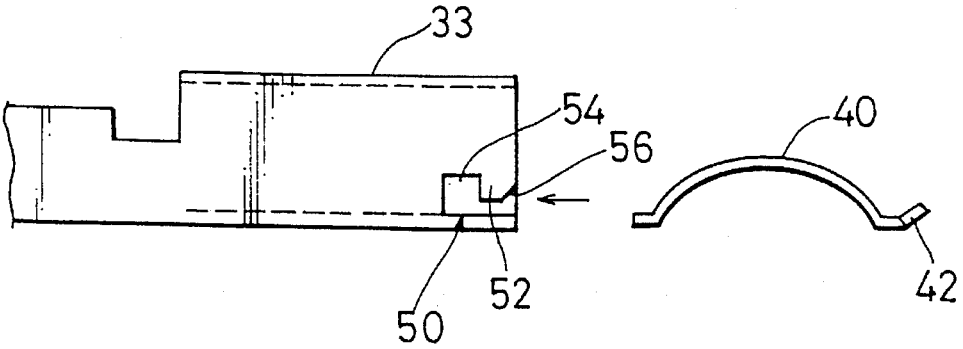
FIG. 6B is a side view showing the female terminal of FIG. 4 in process of manufacturing the same.

In order to complete the above mentioned female terminal 30, the leaf spring 40 previously connected to a linked body (not shown) through the connecting portions 48 as shown in FIGS. 6A and 6B, is inserted into the box part 33 of the main body 37, which has been formed to be box-shaped from the start, from an opening end thereof.

Figure 7:
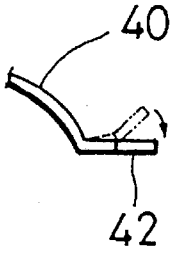
FIG. 7 shows a movement of raised projections of the female terminal of the present invention in process of manufacturing the same.

With such an insertion of the leaf spring 40, the raised projections 42 are inserted into the engaging notches 50 and correspondingly, the raised projections 42 are urged by the engaging projections 52, so that the former can pass through the later, deforming elastically as shown with an arrow in FIG. 7. At this time, being formed at each front end of the engaging projections 52, each of the slanted surfaces 56 allows the raised projection 42 to pass through each of the engaging projections 52 smoothly. Under condition that the projections 42 of the leaf spring 40 have passed through the engaging projections 52 of the notches 50, since the projections 42 are raised due to their elasticity, it is possible to prevent them from coming out of the engaging notches 50, respectively. Since the raised projections 42 are engaged into the engaging notches 50 securely, the leaf spring 50 can be set up in position in the box part 33, respectively. After the leaf spring 40 is set up in the box part 33, the portion 48 connecting the spring 40 with the linked body is cut at the opening end of the box part 33, whereby the female terminal 30 can be completed.

Figure 8:
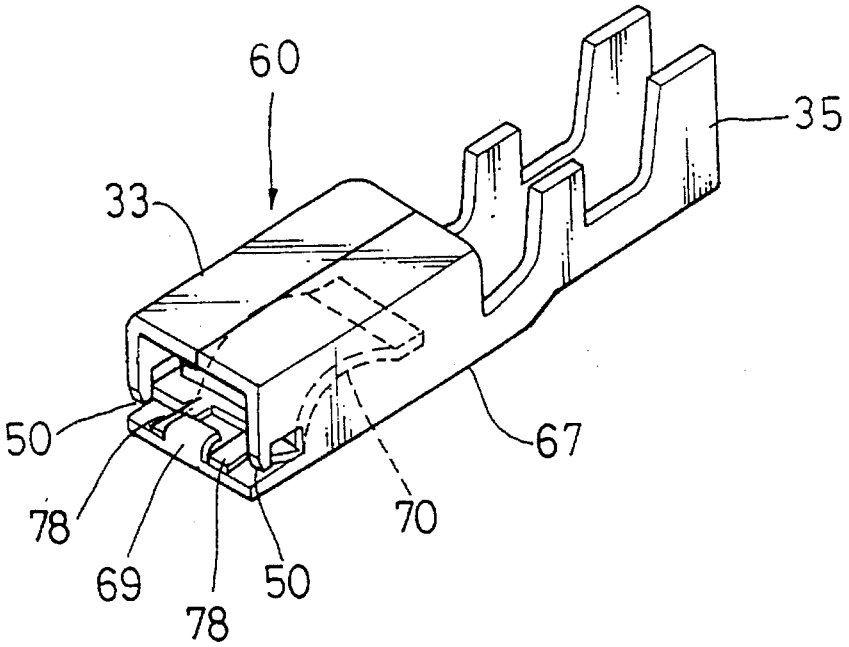

Another embodiment of the present invention is shown in FIG. 8, which is similar to FIG. 4. In FIG. 8, the elements similar to those of FIG. 4 are indicated be the same reference numerals.

In this second embodiment, improvements are adapted for a main body 67 of a female terminal 60 and correspondingly, connecting portions 78 of a leaf spring 70. A turnover piece 69 is formed on a bottom wall of the box part 33 at the opening end thereof. The turnover piece 69, which has a leading end facing the inside of the box part 33, is interposed between the connecting portions 78 of the leaf spring 70 under condition that it is set up in the box part 33. By providing the turnover piece 69 to the box part 33, it becomes to be possible to prevent the leaf spring 70 from coming out of the box part 33 securely. With the arrangement, when the not-shown male terminal is engaged into the box part 33, the former is inserted thereinto, riding on the turnover piece 69. Therefore, there can be eliminated such a possibility that the end of the leaf spring 70 would obstruct the intrusion of the male terminal, whereby it can be set up in the box part 33 smoothly.

As mentioned above, since the engaging notches are provided instead of the through bores of the conventional female terminal, the leaf spring can be set up in the box part instantly if only the leaf spring is inserted thereinto through the opening end thereof. Therefore, it is possible to form the box part in a completed shape, prior to the setting of the leaf spring into the box part, whereby it is possible to eliminate such a complicated process as the box part is deformed again after setting up the leaf spring in the conventional female terminal. Consequently, such an arrangement allows the manufacturing process to be simplified thereby facilitating to manufacture the same. Furthermore, since the leaf spring is set up in the box part having a previously closed configuration, it is hard to cause the deviation of the leaf spring, whereby it is possible to set up it in a certain position.

Further, according to the invention, since each of the engaging projections is provided at a front end thereof with the slanted surface, it is possible to execute the inserting operation of the leaf spring with ease thereby improving the workability of assembling the leaf spring.

Finally, it will be understood by those skilled in the art that the forgoing description of the preferred embodiments of the disclosed structure, and that various changes and modifications may be made to the present invention without departing from the spirit and scope thereof.

What is claimed is:

1. A female terminal for receiving a male terminal, comprising:

a main body having a box part for receiving said male terminal, said box part having an opening formed at one end thereof;

a leaf spring arranged in said box part;

elastic raised projections arranged on each of two sides of an end of said leaf spring in a longitudinal direction thereof;

engaging notches formed in respective side walls of said box part, respectively, through which said raised projections are to be inserted from said opening of said box part; and engaging projections arranged at respective inlets of said engaging notches so as to deform said raised projections elastically when they are passing through said engaging projections and to prevent said raised projections restored elastically to their original configurations from disengaging with said engaging notches after said raised projections pass through said engaging projections.

2. A female terminal for receiving a male terminal, comprising:

a main body having a box part for receiving said male terminal, said box part having an opening formed at one end thereof;

a leaf spring arranged in said box part;

elastic raised projections arranged on each of two sides of an end of said leaf spring in a longitudinal direction thereof;

engaging notches formed in respective side walls of said box part, respectively, through which said raised projections are to be inserted from said opening of said box part; and engaging projections arranged at respective inlets of said engaging notches so as to deform said raised projections elastically when they are passing through said engaging projections and to prevent said raised projections restored elastically to their original configurations from coming out of said engaging notches after said raised projections pass through said engaging projections, each of said engaging projections being provided at said inlet with a slanted surface for facilitating said elastic deformation of each of said raised projections.

3. A female terminal for receiving a male terminal, as claimed in claim 2, wherein said box part is provided on a bottom wall at the opening end thereof with a turnover piece which has a leading end facing an inside of said box part.

4. A method for manufacturing a female terminal for receiving a male terminal, comprising the following steps of:

preparing a main body which has a box part for receiving said male terminal, said box part having an opening formed at one end thereof and having engaging notches formed in respective side walls thereof, said engaging notches being provided at respective inlets thereof with engaging projections, respectively;

preparing a leaf spring which has elastic raised projections formed on respective sides of an end thereof in a longitudinal direction thereof;

inserting said leaf spring into said box part through said opening of said box part in such a manner that, when said raised projections pass through said engaging projections, said raised projections are deformed elastically by said engaging projections, respectively; and thereafter, engaging said raised projections of said leaf spring with said engaging notches in such a manner that, after said raised projections pass through said engaging projections, said engaging projections prevent said raised projections restored elastically to their original configurations from coming out of said engaging notches, respectively.

5. A method for manufacturing a female terminal for receiving a male terminal as claimed in claim 4, wherein each of said engaging projections is provided at said inlet with a slanted surface for facilitating said elastic deformation of each of said raised projections.

* * * * *